United States Patent [19]

Dudouyt

[11] 4,223,620

[45] Sep. 23, 1980

[54] VESSEL-CATAMARAN TYPE

[76] Inventor: Jean-Paul Dudouyt, "Les Gouttettes", Route du Lac, Coppet, Vaud, Switzerland, CH-1296

[21] Appl. No.: 862,315

[22] Filed: Dec. 20, 1977

[30] Foreign Application Priority Data

Jan. 17, 1977 [CH] Switzerland ..... 508/77

[51] Int. Cl.[2] ..... B63B 35/00; B63H 9/00

[52] U.S. Cl. ..... 114/61; 114/39

[58] Field of Search ..... 9/6 P; 114/39, 61, 65 R, 114/83, 87

[56] References Cited

U.S. PATENT DOCUMENTS

| | | | |
|---|---|---|---|
| 2,616,101 | 11/1952 | Tym | 114/61 |
| 2,917,754 | 12/1959 | Gunderson | 114/61 |
| 3,981,259 | 9/1976 | Harper | 114/61 |
| 4,046,091 | 9/1977 | Lomas | 114/61 |

*Primary Examiner*—Edward R. Kazenske
*Assistant Examiner*—D. W. Keen
*Attorney, Agent, or Firm*—Edwin E. Greigg

[57] ABSTRACT

A catamaran type vessel has two parallel hulls and a metal tubular framework linking the hulls. Rigid members extend longitudinally within the hulls and have extensions projecting from the upper surfaces of the hulls for coupling with the framework. This reduces hull stresses and allows lighter hulls. Expanded plastics foam may be used to hold the rigid members in the hulls. The hulls may be inclined inwardly to give an asymmetrical catamaran type configuration.

9 Claims, 6 Drawing Figures

VESSEL-CATAMARAN TYPE

BACKGROUND OF THE INVENTION

1. Field of the Invention:

The invention relates to vessels of the catamaran type which comprise two substantially parallel hulls each forming a caisson having a base and a top surface, and a frame interconnecting these two hulls.

2. Description of the Prior Art:

In known vessels of this type, the frame is secured to the hulls at their top surfaces. The hulls may thus be subjected to torsional forces along their longitudinal axes, and these forces may be relatively large. It is therefore necessary to provide that the hulls are strong and this results in their being relatively heavy.

SUMMARY OF THE INVENTION

An object of the present invention is to simplify the construction of the hulls and to render them less costly and lighter.

To this end, the invention provides that in a catamaran type vessel the means for securing the frame to the hulls comprises rigid parts which extend longitudinally in the respective hulls, each rigid part having at least one extension extending from the base to the top surface of the hull.

BRIEF DESCRIPTION OF THE DRAWINGS

The invention will further be described with reference to the accompanying drawings, of which:-

Figure 1:
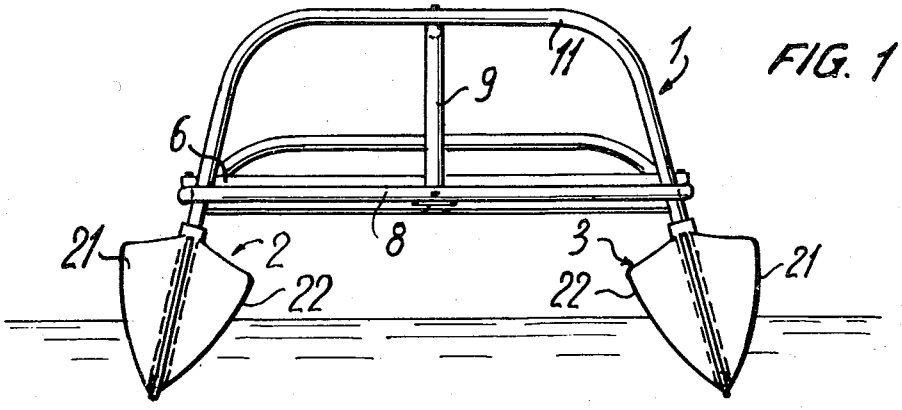
FIG. 1 is a front view of a vessel in accordance with the invention.
Figure 2:
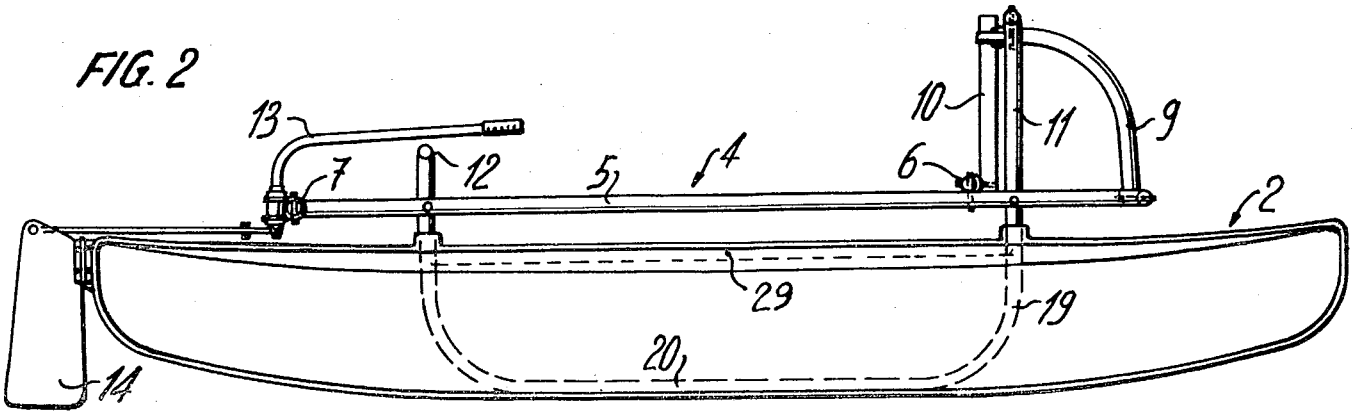
FIG. 2 is a side view of the vessel of FIG. 1.

DETAILED DESCRIPTION OF THE PREFERRED EMBODIMENTS:

Referring to FIGS. 1 and 2, the vessel comprises a frame 1 consisting of an assembly of tubes and interconnecting two hulls 2 and 3.

The frame 1 comprises a tube 4 bent to the shape of a U in a horizontal plane, the two longitudinal limbs 5 of this tube being interconnected by two transverse tubes 6 and 7. The two limbs 5 are interconnected by the rounded central portion 8 or the tube 4. This portion 8 carries a tubular elbow 9, the upper end of which is connected to a vertical tube 10 forming the step of a mast, not illustrated. The upper portion of the tube 9 is also connected to a forward transverse bowed element 11. The frame also comprises a rear transverse bowed element 12 as well as a bar 13 for controlling two rudders 14 each pivotably mounted to the rear of a respective hull.

Figure 3:
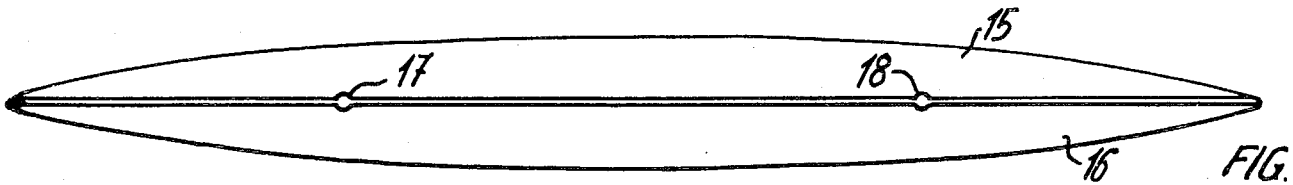
FIG. 3 is a plan view of a hull of the vessel of FIGS. 1 and 2.
Figure 4:
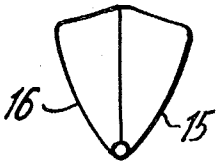
FIG. 4 is a cross-section through the hull of FIG. 3.

As shown in FIGS. 3 and 4, each hull is formed by two moulded shells 15 and 16 which are symmetrical with respect to each other and are interconnected along a jointing surface disposed in a longitudinal plane of the hull. These shells may be made of moulded material and attached to each other in any known manner, for example by bonding or thermoplastic welding.

These shells 15 and 16 are so shaped as to form in the top surface of the hull two orifices 17 and 18 through which emerge extension parts 19 of a U-shaped tube 19, 20. The central portion 20 of this tube extends longitudinally along the base of the hull and thus contributes to its rigidity. The two upper ends of the tube 19, 20 are interconnected by a tube 29 and project a few centimetres above the hull to form sleeves to enable the hull to be detachably secured to the frame 1.

The hull is filled, at least partially, with an expanded plastics resin forming a rigid foam. This rigid foam contributes to the rigidity of the walls of the hulls and provides the mechanical connection between the walls of the hulls and the tube 19, 20.

The above-described construction is very advantageous since it enables an excellent mechanical connection to be established between the frame and the hulls, as well as imparting considerable solidity to the hulls even if their walls are thin.

Also, as shown in FIG. 1, the hulls can be secured to the frame in such manner that the planes of symmetry of the hulls are inclined. Due to the fact that, amidships, the hulls are of general V-shaped construction, the planes of symmetry of the hulls can be inclined to provide a vessel having hulls, the outer faces 21 of which, are substantially perpendicular to the plane flotation or at any rate do not diverge by more than about thirty degrees thereform. The plane of flotation is normally horizontal, of course and the perpendicular thereto vertical. The inner sides 22 are fairly sharply inclined to the vertical. Thus the vessel has characteristics which closely approach those of vessels of the asymmetric catamaran type, while at the same time it has hulls which are formed by two symmetrical halves so that it is relatively inexpensive to construct.

Figure 6:
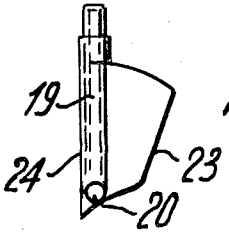
FIGS. 5 and 6 are respectively a plan view and a cross-sectional view of another form of hull of a vessel in accordance with the invention.
Figure 5:
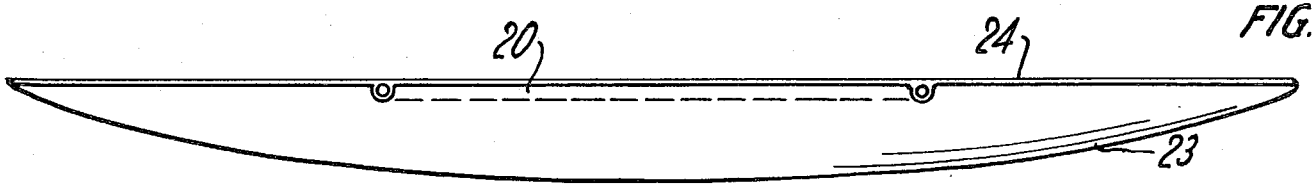

However, the invention can also be used for providing a vessel having asymmetrical hulls, as shown in FIGS. 5 and 6, so that a strictly asymmetrical catamaran is obtained. In this case, each hull comprises only one shell 23 which has a planar or substantially planar wall 24. The hull is also provided with a tube 19, 20, which forms, with the tube 29, a part which imparts rigidity to the whole assembly and establishes a connection with the frame 1.

Numerous modifications are of course possible, and it will be obvious that the part for imparting rigidity to each hull could be constituted by any suitable means other than the tube 19, 20. However, this metal tube offers certain advantages from the point of view of ease of manufacture and low cost.

It should also be mentioned that when the vessel is beached, practically all of its weight rests on the horizontal portion 20 of the tube 19, 20, so that the hulls are subjected to virtually no mechanical load.

Depending upon the dimensions of the vessel, the rigid part for connecting a hull to the frame could have only one vertical extension or could be provided with more than two such extensions.

The production of each hull by fitting together two identical shells has a favourable effect on the manufacturing costs. The two shells do not necessarily need to be connected along a longitudinal plane, but that they could alternatively be fitted together along a line contained in a plane transverse to the longitudinal axis of the hull.

I claim:

1. A vessel of the catamaran type comprising two substantially parallel hulls each forming a caisson having a base and top surface; a frame of U-shaped configuration for interconnecting the two hulls, said frame including a pair of substantially parallel spaced-apart limb portions and an arcuately shaped central portion with each of said limb portions extending fore and aft above a respective one of said caissons, transversely extending longitudinally spaced means for interconnecting said limb portions, two rigid members, each one of U-shaped configuration extending longitudinally fore and aft along the bottom of each respective hull; each of said rigid members including an upstanding extension at each of its ends, the extensions extending from the base to the top surface of the respective hull; said frame interconnecting the hulls by engagement of said extensions with a respective limb portion of said frame.

2. A vessel as claimed in claim 1, including orifices in the top surfaces of the hulls, each extension passes through an orifice to present a projection above the respective top surface, and said limb portions engage said projections.

3. A vessel in accordance with claim 2, including a longitudinally extending, centrally disposed member on the top surface of each of said caissons for interconnecting the upper ends of said extensions.

4. A vessel as claimed in claim 1 wherein each hull is formed by a hollow body which is symmetrical in relation to a longitudinal plane.

5. A vessel according to claim 4, wherein the planes of symmetry of the two hulls are inclined so that the line of intersection of the planes is located above the waterline.

6. A vessel as claimed in claim 5, wherein said hulls are generally V-shaped amidships and the inclination of said planes of symmetry is so selected that the exterior side of each hull diverges from the perpendicular to the plane of flotation by 30° or less.

7. A vessel as claimed in claim 1, wherein each hull has an exterior side which is substantially planar and is disposed substantially perpendicularly to the plane of flotation.

8. A vessel as claimed in claim 1 wherein each hull is formed by two identical parts made of moulded synthetic resin and fitted together each hull being at least partially filled with an expanded plastics resin forming a rigid foam and contributing to the rigidity of the walls of the hulls.

9. A vessel in accordance with claim 1, wherein said frame includes angularly disposed portions for oblique engagement of said frame with said extensions so that the planes of symmetry of said hulls are inclined.

* * * * *